US012365557B2

(12) United States Patent
Schubring

(10) Patent No.: US 12,365,557 B2
(45) Date of Patent: Jul. 22, 2025

(54) CENTER DRIVE UNWIND SYSTEM

(71) Applicant: BW Converting, Inc., Green Bay, WI (US)

(72) Inventor: Cory L. Schubring, De Pere, WI (US)

(73) Assignee: BW CONVERTING, INC., Green Bay, WI (US)

( * ) Notice: Subject to any disclaimer, the term of this patent is extended or adjusted under 35 U.S.C. 154(b) by 303 days.

(21) Appl. No.: 18/110,435

(22) Filed: Feb. 16, 2023

(65) Prior Publication Data

US 2023/0294946 A1 Sep. 21, 2023

Related U.S. Application Data

(60) Provisional application No. 63/321,171, filed on Mar. 18, 2022.

(51) Int. Cl.

| | |
|---|---|
| ***B65H 19/18*** | (2006.01) |
| ***B65H 19/12*** | (2006.01) |
| ***B65H 21/00*** | (2006.01) |
| *B65H 16/04* | (2006.01) |
| *B65H 19/20* | (2006.01) |

(52) U.S. Cl.

CPC ..... *B65H 19/1863* (2013.01); *B65H 19/123* (2013.01); *B65H 19/1836* (2013.01); *B65H 21/00* (2013.01); *B65H 16/04* (2013.01); *B65H 19/20* (2013.01); *B65H 2301/41358* (2013.01); *B65H 2301/41726* (2013.01); *B65H 2301/4175* (2013.01); *B65H 2301/4621* (2013.01); *B65H 2301/46312* (2013.01)

(58) Field of Classification Search

CPC ..... B65H 19/12; B65H 19/18; B65H 19/123; B65H 19/1836; B65H 19/1863; B65H 21/00

See application file for complete search history.

(56) References Cited

U.S. PATENT DOCUMENTS 4,082,599 A * 4/1978 Kozima ..... B65H 19/1873 242/555.4
4,802,632 A * 2/1989 Fukuda ..... B65H 19/105 242/532.5

(Continued)

FOREIGN PATENT DOCUMENTS

EP 3628615 A1 4/2020
IT 102019000008586 1/2022

(Continued)

*Primary Examiner* — Sang K Kim

(74) *Attorney, Agent, or Firm* — Thompson Coburn LLP

(57) ABSTRACT

A method for unwinding includes loading a first reel of web material into a first unwind position where the web is unwound. A splicing unit is then moved in the machine direction toward the first unwind position until there is sufficient space to allow a further reel to be loaded into a second unwind position where the web from the second reel is unwound once loaded. Then, the web from the first reel is spliced to the second reel, and the web of the first reel is thereafter cut. The process continues in the opposite direction after removing the first reel from the first unwind position. The web of the second reel is unwound in the second position, the splicing unit is moved toward the second unwind position until there is sufficient space to allow a further reel to be loaded into the first unwind position.

10 Claims, 20 Drawing Sheets

(56) References Cited

U.S. PATENT DOCUMENTS

| | | | | |
|---|---|---|---|---|
| 5,697,575 | A * | 12/1997 | Moore | B65H 19/1863 242/555.3 |
| 5,906,333 | A | 5/1999 | Fortuna et al. | |
| 5,934,604 | A | 8/1999 | Klimek | |
| 6,440,268 | B1 | 8/2002 | Baggot et al. | |
| 7,441,579 | B2 * | 10/2008 | Adami | B65H 19/1863 156/507 |
| 7,832,682 | B2 | 11/2010 | Keller et al. | |
| 8,011,409 | B2 * | 9/2011 | Adami | B65H 19/1863 156/507 |
| 9,670,020 | B2 | 6/2017 | Morelli et al. | |
| 11,254,535 | B2 | 2/2022 | Schubring et al. | |

FOREIGN PATENT DOCUMENTS

| | | | |
|---|---|---|---|
| WO | 9520537 | A1 | 8/1995 |
| WO | 2004080867 | A2 | 9/2004 |

* cited by examiner

UWS2

UWS4

UWS4

UWS4

UWS4

UWS4

UWS4

CENTER DRIVE UNWIND SYSTEM

RELATED APPLICATION DATA

This application claims priority benefit to U.S. provisional application Ser. No. 63/321,171, filed Mar. 18, 2023, the disclosure of which is incorporated by reference herein.

BACKGROUND

This disclosure is directed to methods and apparatus for unwinding reels (also known as parent rolls), and more particularly toward unwinding reels of bathroom tissue and kitchen towel for the production of consumer rolls in a converting line, and more particularly very large diameter reels.

It is well known in the art that there are two categories of unwinding machines for converting lines: surface belt-driven and center-driven. surface belt-driven unwinding machine makes use of core shafts or core plugs inserted into the core of a reel to support the reel on an unwind stand, with the power for unwinding provided by typically two or four driven belts loaded against the reel surface. center-driven unwinding machine makes use of core chucks inserted into the core of a reel to support the reel on an unwind stand, with the power for unwinding provided by driving one or both of the chucks.

As recently as thirty years ago, the maximum reel diameter in the tissue/towel industry was around 2.5 m. Recently, 3.0 m diameter reels have become more common. Some tissue machines can produce reels 3.6 m or more in diameter. Ever-larger diameter reels are desired by producers because, the longer the web length wound on each reel, the longer the converting line can run at full speed before the line is slowed down or stopped in order to splice onto a new reel. (In some industries, winding the reels more tightly is a viable strategy for getting a longer web length on the reel, but this is not applicable to the tissue/towel industry because the tissue/towel has a thickness and structure that must be preserved.) Depending on the wound length on the reel and the web speed, each reel typically lasts around 30-90 minutes, which means a 2-ply line may be undergoing a reel change around every 15-45 minutes. Unwinding machines for very large parent reels are naturally physically large: they must be at least as large as the reels they unwind. This physical size is compounded as more plies are introduced, and as automatic splicing is introduced. For example, a 2-ply automatic splicing unwind may have four unwind stands: one running position and one standby position for each of the two plies. Very large reels also tend to have relatively large core diameters, on the order of 400-500 mm or more.

There are several considerations in unwinding machine design. Tradeoffs must often be made among them, and the relative importance of each can vary by producer and by converting line mill site:

- Operator considerations:
  - Operator safety
  - Ergonomics
  - Ease of access
  - Skills required
- Cost considerations:
  - Unwinding machine acquisition and maintenance costs
  - Unwinding machine energy efficiency
- Operational considerations:
  - Converting line efficiency: for what durations the line is stopped, and for what durations and at what web speeds the line runs slowly

- Operator utilization
  - Extent to which timing of operator tasks is driven by events on the machine
  - Height required for loading reels
  - Means for removing expired reels
  - Whether an overhead crane is required for any tasks
  - How breaks in the web within a reel are handled, and whether any staged reels need to be removed from their staging position to do so
  - Opportunities for reel delivery via automatic guided vehicle (AGV)
  - Opportunities for expired reel removal via automatic guided vehicle (AGV)
- Machine specifications:
  - Maximum reel diameter
  - Maximum reel mass moment of inertia (or weights at various diameters)
  - Level of wound-in tension in the reel
  - The diameter the running reel must be unwound to before a new reel can be staged for loading and/or loaded into the unwind
  - Maximum expired reel diameter that can be expelled via automatic means
  - Web speed
  - Deceleration rates for normal, fast, and emergency stop
  - Maximum allowable out-of-round while maintaining tension control
  - Whether the reel can be rotated in either direction to unwind
  - Whether hydraulic power is acceptable for power transmission
- Machine physical size:
  - Machine-direction footprint
  - Cross-direction footprint
  - Machine height U.S. Pat. Nos. 5,906,333, 5,934,604, 6,440,268, 7,832,682, and U.S. Ser. No. 11/254,535, the disclosures all of which are incorporated by reference herein, disclose various subsystems for and embodiments of center driven unwinding machines. Italian patent IT 102019000008586 and U.S. Pat. No. 9,670,020 show embodiments of surface belt-driven unwinding machines. The unwinding machines of these embodiments have combinations of pros and cons regarding the design considerations discussed above.

As will become evident from the discussion that follows, the methods and apparatus described herein provide for unwinding machines with various attractive combinations of these considerations.

DETAILED DESCRIPTION

Figure 1:
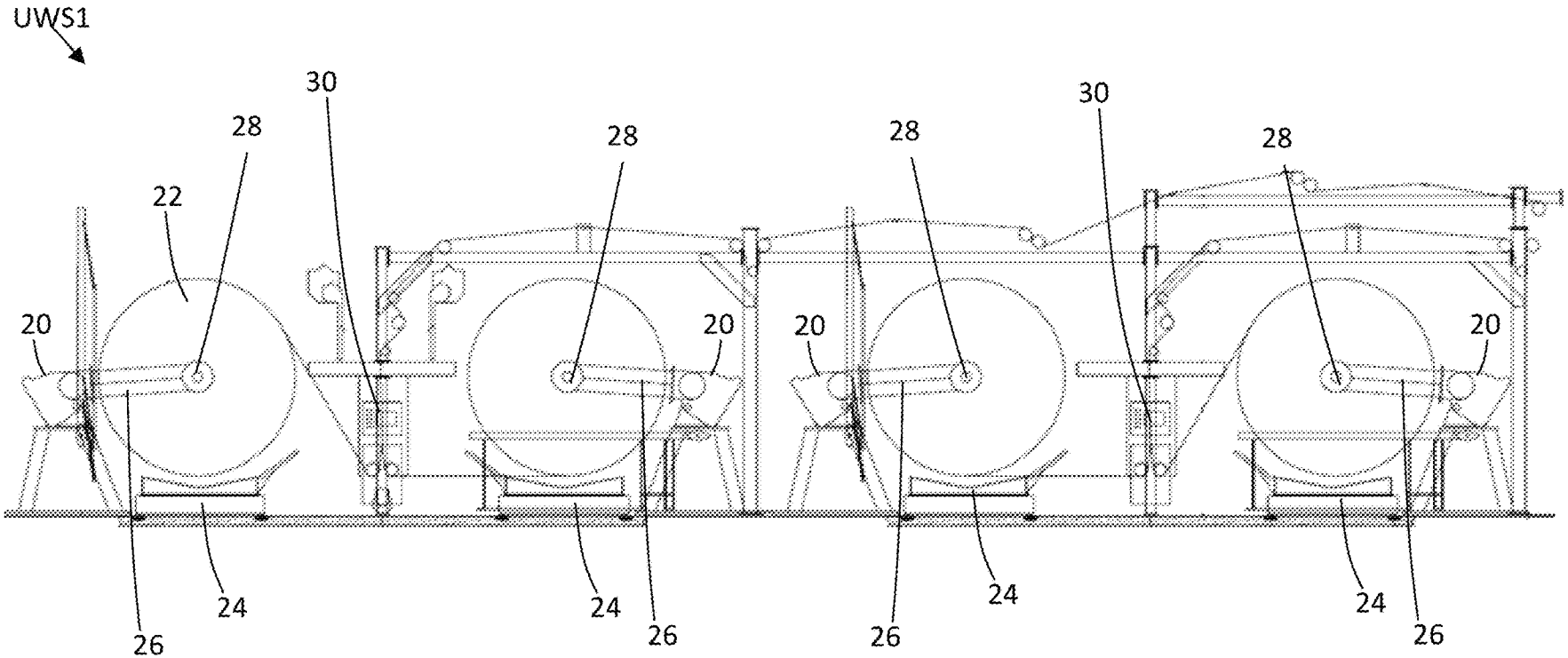
FIG. 1 is an elevation view of an exemplary unwinding machine.
Figure 2:
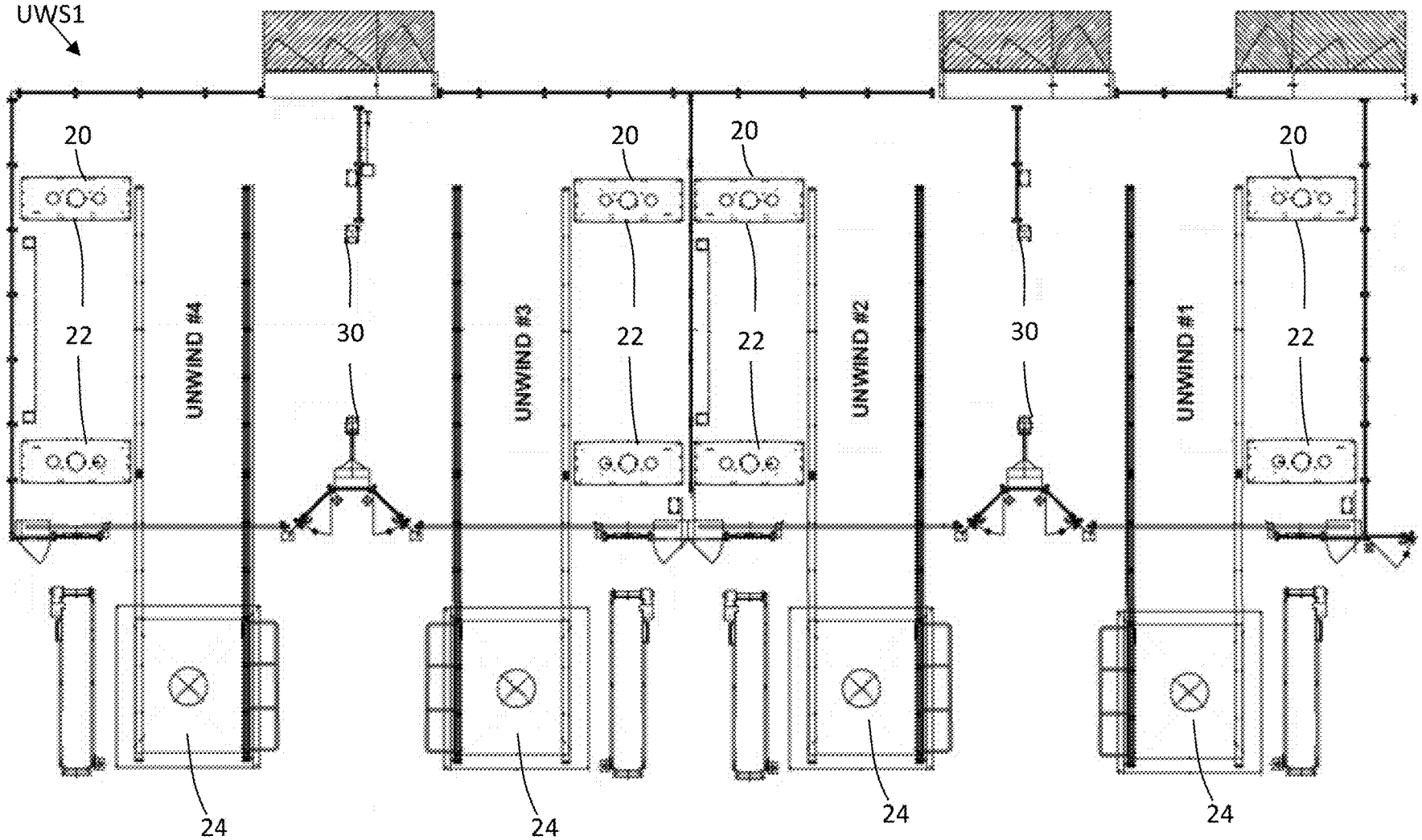
FIG. 2 is a plan view of the unwind system of FIG. 1
Figure 5:
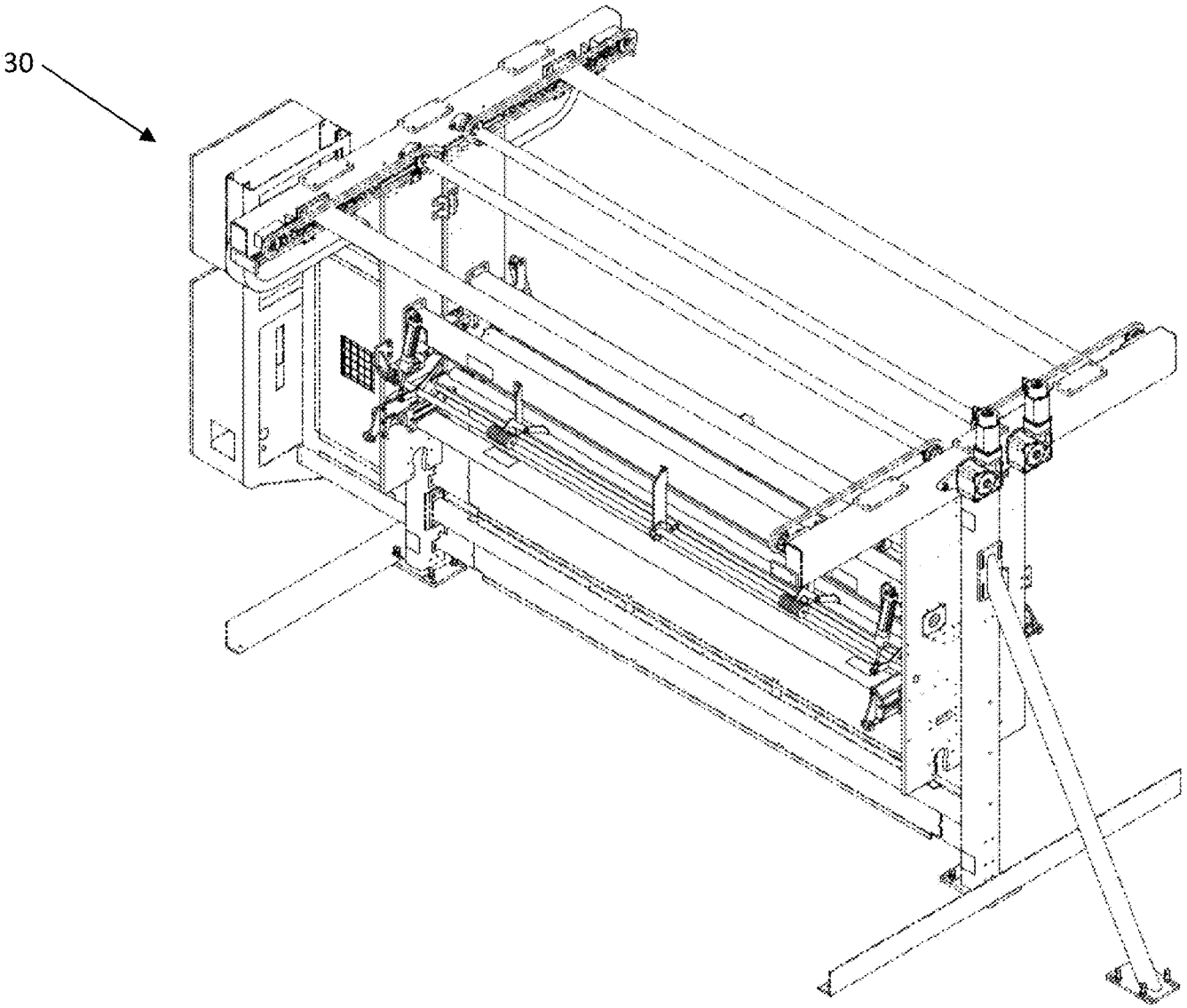
FIG. 5 is a perspective view of an exemplary web splicing unit
Figure 6:
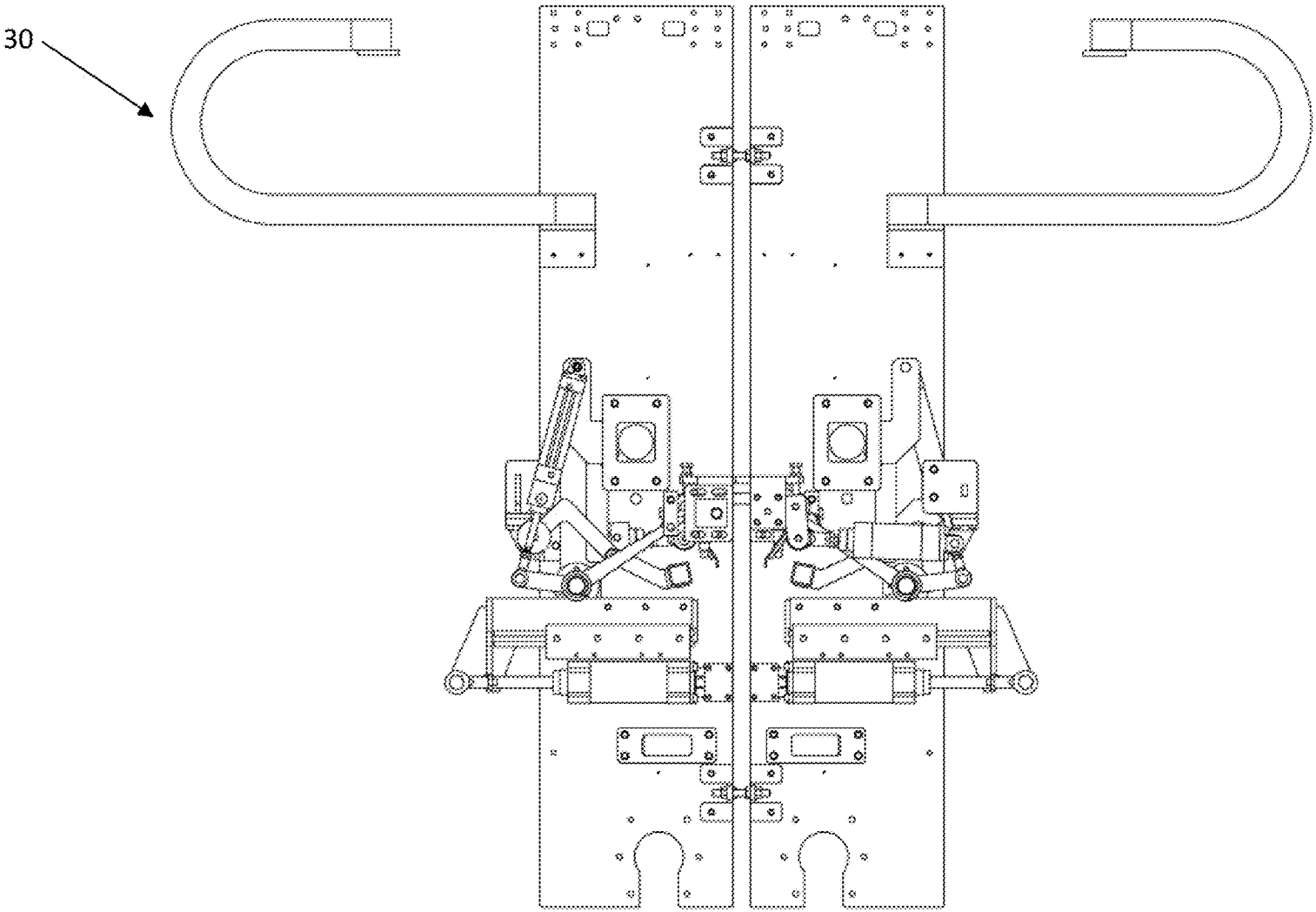
FIG. 6 is an elevation view of the web splicing unit of FIG. 5

FIGS. 1 and 2 show an exemplary unwinding system UWS1 with four unwind stands 20. The unwind system UWS is configured for running two plies in an automatic splicing mode. Reels 22 are loaded into each unwind stand 20 via a loading cart 24 at the operator side of the machine. Expired reels are removed from the unwind stand 20 via conveyors (not shown) at the operator side of the machine. The reel loading carts 24 and/or the expired reel conveyors can be omitted, with their functions provided instead by automatic guided vehicle (AGV). The unwind stand 20 includes reel loading arms 26 that are provided with chucks 28, at least one of which is driven. The reel loading arms 26 rotate and move in the cross-machine direction to locate and engage the core of the reel 22, and lift the reel into position for unwinding. A splicing unit 30, for example as shown in FIGS. 5 and 6 in which the splice is made via double-sided tape, is disposed between each pair of unwind stands 20, and a splice is made in alternating directions (right to left and left to right) between the pairs of unwind stands 20. In the alternative, the splicing unit 30 may be of a known type using knurled plybonding wheels to mechanically knit the plies together. An unwinding machine of this embodiment has a combination of pros and cons regarding the design considerations discussed above which may be attractive for some producers.

Figure 3:
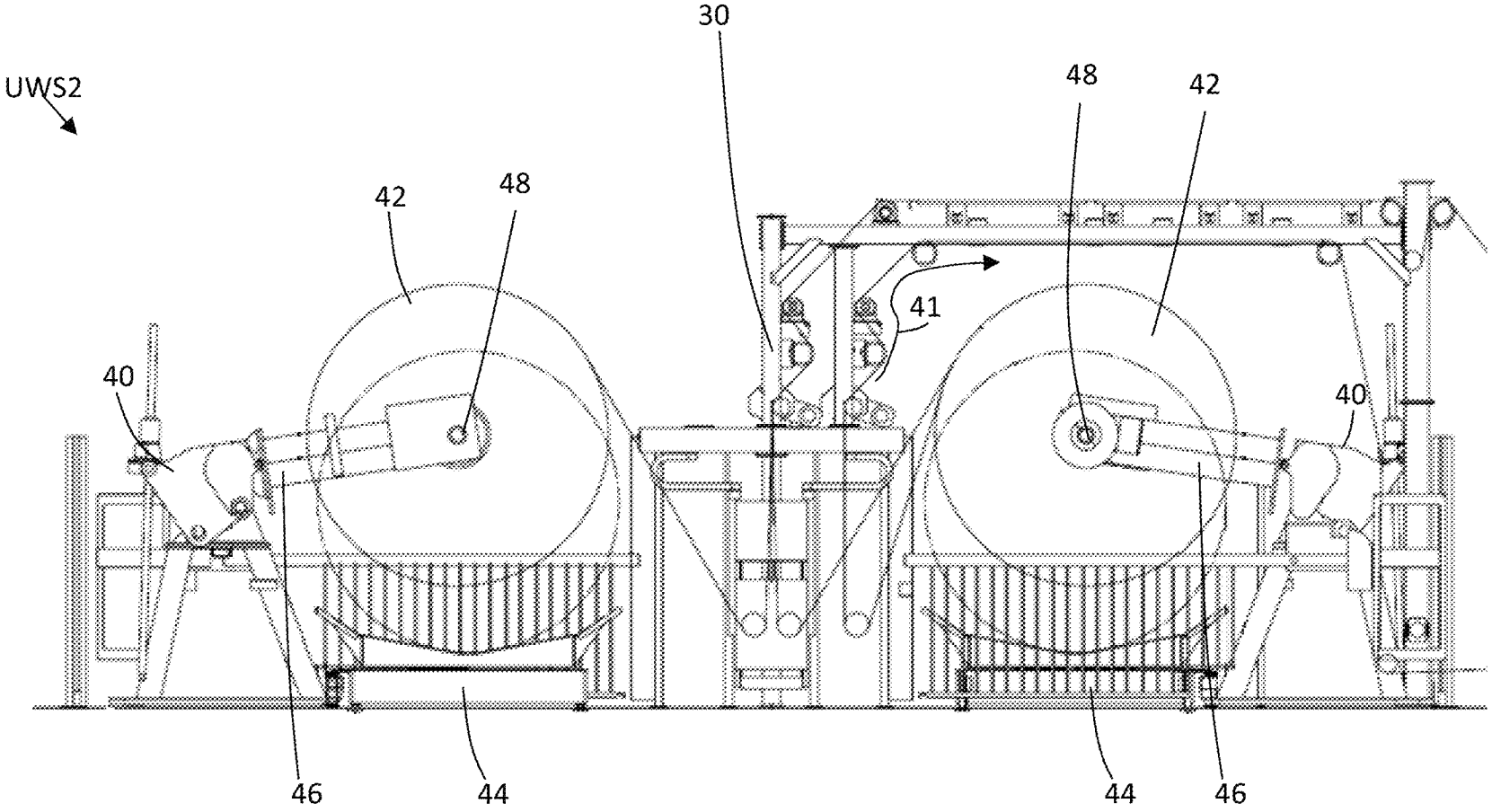
FIG. 3 is an elevation view of an exemplary unwinding machine.
Figure 4:
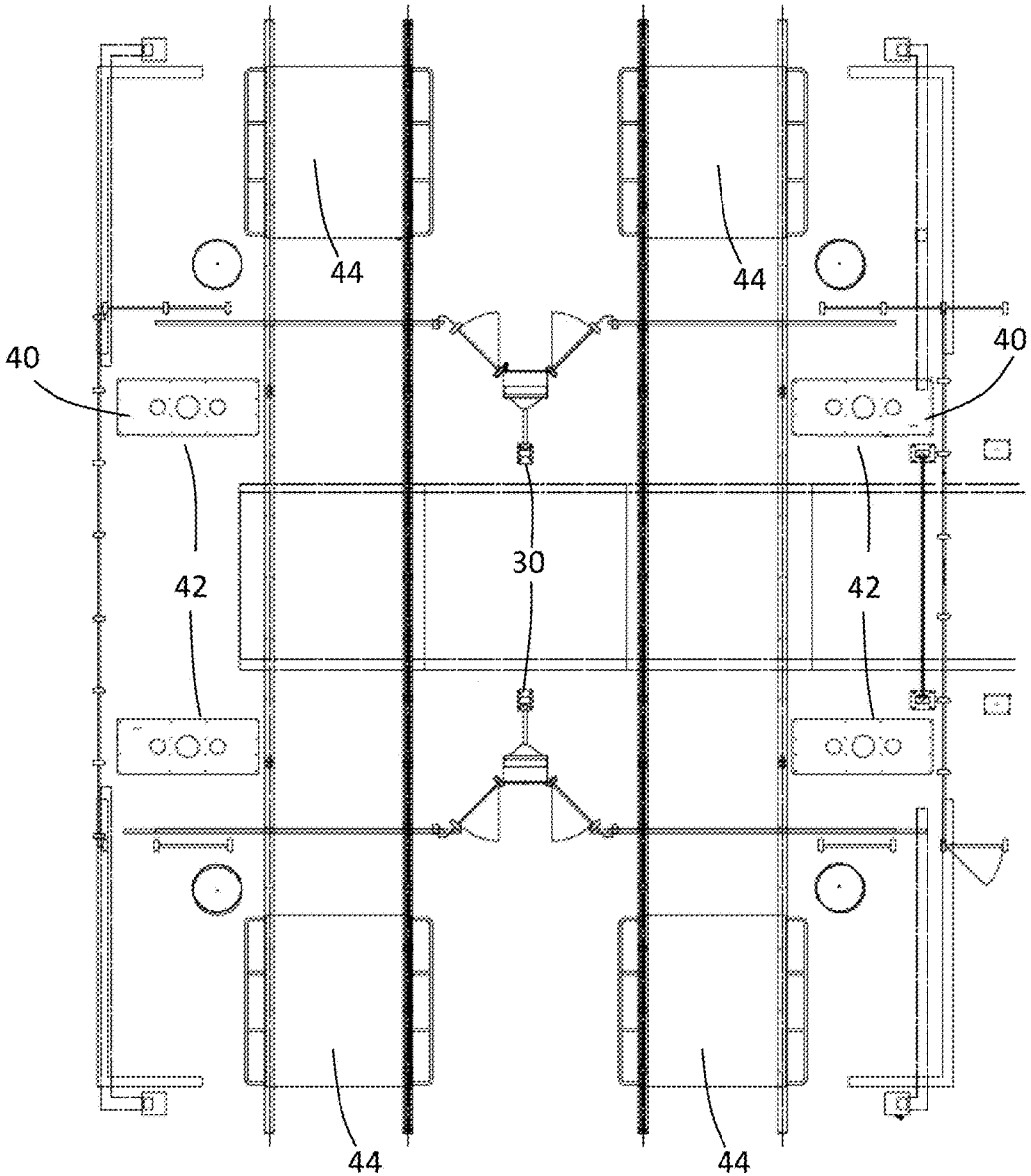
FIG. 4 is a plan view of the unwinding machine of FIG. 3.

FIGS. 3 and 4 show another exemplary unwinding system UWS2 that has an unwind stations 40 configured for running one ply in an automatic splicing mode, or two plies in a manual splicing mode. The capability to run two plies in a manual splicing mode is provided by the second independent web path 41. Reels 42 are loaded via loading carts 44 at the operator side of the machine. Expired reels are removed from the unwind via carts at the drive side of the machine. The reel loading carts and/or the expired reel carts can be omitted, with their functions provided instead by automatic guided vehicle (AGV). Reel loading arms 46 are provided with chucks 48, at least one of which is driven. The reel loading arms 46 rotate and move in the cross-machine direction to locate and engage the core of the reel, and lift the reel into position for unwinding. The splicing unit 30, for example as shown in FIGS. 5 and 6 in which the splice is made via double-sided tape, is disposed between each pair of unwind stands 40, and a splice is made in alternating directions (right to left and left to right) between the pairs of unwind stands. In the alternative, the splicing unit may be of a known type using knurled plybonding wheels to mechanically knit the plies together. An unwinding machine of this embodiment has a combination of pros and cons regarding the design considerations discussed above which may be attractive for some producers.

Figure 7A:
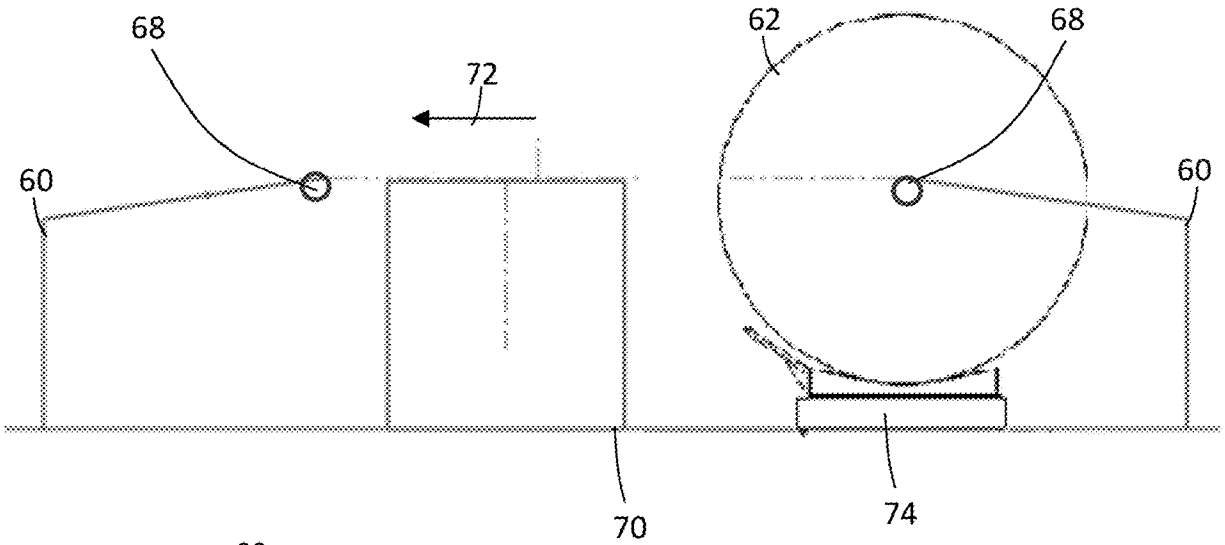
FIGS. 7A through 7D are elevation sketches of an embodiment of an unwinding machine of the present invention.
Figure 7B:
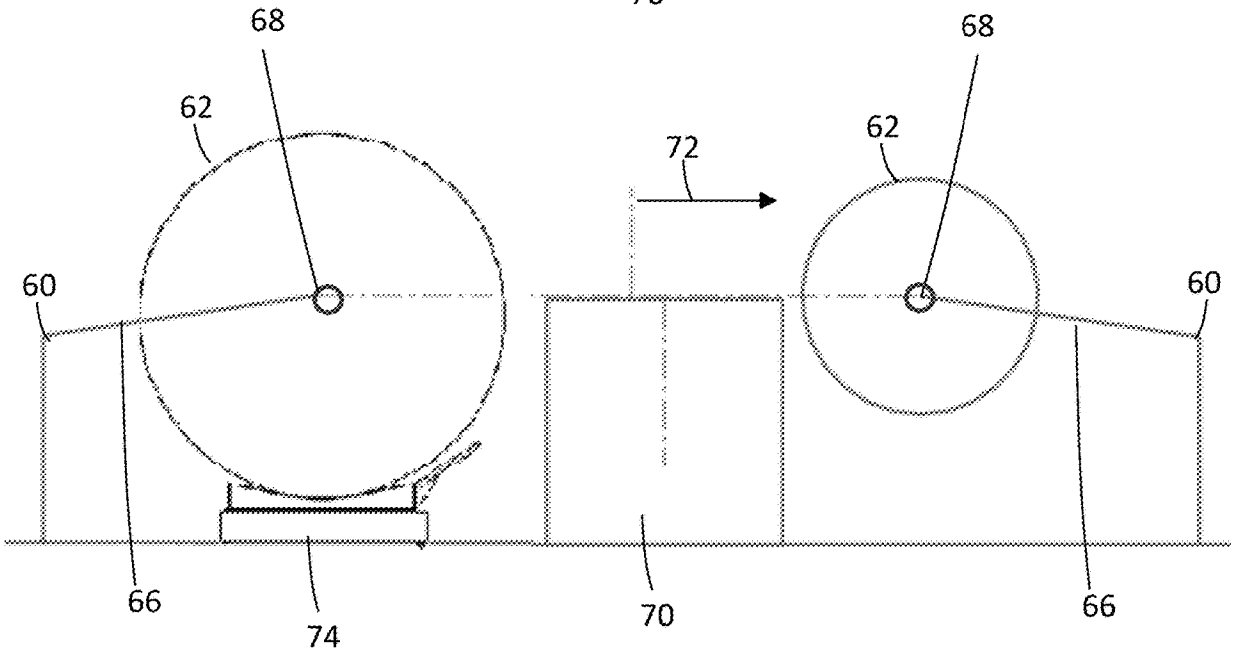
Figure 7C:
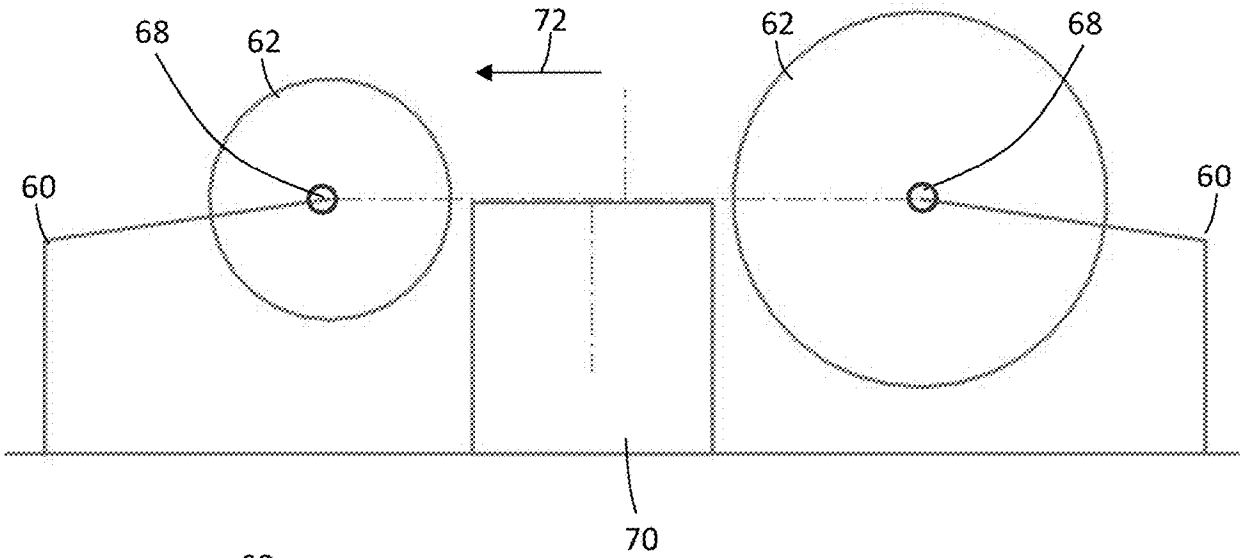
Figure 7D:
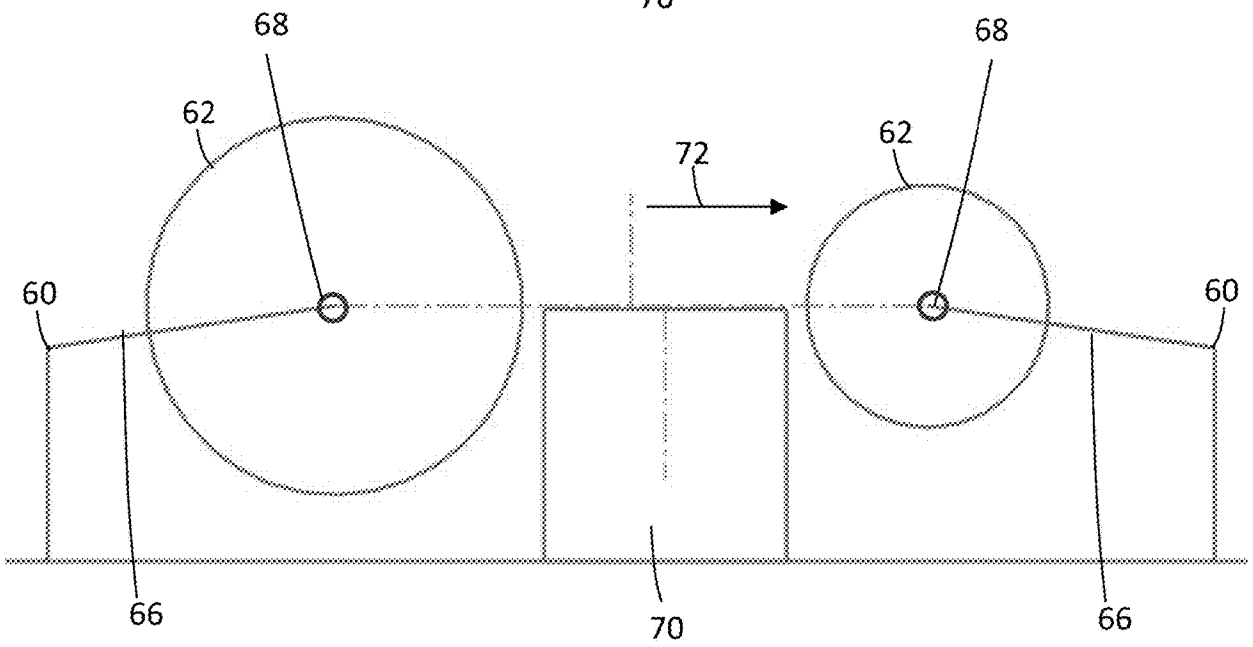

FIGS. 7A through 7D show a further embodiment of an unwinding system UWS3 with unwind stands 60 with reels 62, arms 66 and chucks 68 in an automatic splicing arrangement with one ply of web material. The embodiment of the unwind system UWS3 of FIGS. 7A and 7B is similar to the embodiments of the unwind systems UWS1, UWS2 of FIGS. 1 and 2 and FIGS. 3 and 4. The main difference of the embodiment of the unwind system UWS3 of FIGS. 7A and 7B from the embodiments of the unwind systems UWS1, UWS2 of FIGS. 1 and 2 and FIGS. 3 and 4 is that the splicing unit 70 disposed between the unwind stands 60 is configured for reciprocation motion 72 in the machine direction. The splicing unit 70 is movable in the machine direction 72 because the unwind stands 60 are positioned closer together in the machine direction than they would be if a reel 62 of maximum diameter could be loaded into either unwind position defined by an unwind stand 60 at any time (as is the case with the machines of FIGS. 1 and 2 and FIGS. 3 and 4). The reels 62 may unwind either clockwise or counter-clockwise in the unwind station 60. As the running reel unwinds, the splicing unit 70 moves toward the running reel, maintaining an approximately constant distance between the splicing unit and the running reel, until there is sufficient space to allow a reel to be loaded into the other unwinding station. In FIG. 7A, the reel 62 has been brought into the right unwind position to be loaded in the right unwind stand 60, and the splicing unit 70 has moved far enough to the left to allow the new reel 62 on the right to be loaded into the right unwind station 60. In FIG. 7B, the reel 62 on the right is unwinding, and the splicing unit 70 has moved far enough to the right to allow the new reel 62 on the left to brought into a unwind position to be loaded into the left unwind station 60. FIGS. 7C and 7D show the reciprocating motion of the splicing unit 70. The mobility of the splicing unit 70 in the machine direction 72 can be provided with any of several known means, for example, linear bearings, wheels, cam followers. The movement of the splicing unit 70 in the machine direction 72 can be provided with any of several known means, for example a rack and pinion drive, pneumatic or hydraulic cylinder(s), rodless cylinder(s), linear servo motor(s). The new reel may be loaded in the left or right unwind position in the respective unwind stand 60 to be engaged with the reel lifting chucking arms 66 with a reel loading cart 74. An advantage with the unwind system UWS3 of FIGS. 7A and 7B is that the machine-direction floor space is reduced by the same amount that the maximum running reel radius is reduced. A drawback with this arrangement is that the running reel must be unwound to a certain diameter before a new reel of maximum diameter can be loaded into the standby position. If loading carts are provided, a new reel of maximum diameter can be loaded onto a loading cart at any time, with the main risk being that if the cart is needed to remove a reel that is still relatively large in diameter, for example, because its quality is poor, then the new reel will need to be removed from the loading cart before the loading cart can be used to remove the bad reel. The embodiment of the unwind system UWS3 of FIGS. 7A and 7B can be duplicated for 2-ply automatic splicing, for instance, as shown by the unwind system UWS1 of FIGS. 1 and 2. The embodiment of the unwind system UWS3 of FIGS. 7A and 7B can be provided with the second independent web path, for instance, as shown by the embodiment of the unwind system UWS2 of FIGS. 3 and 4, for capability to run two plies in a manual splicing mode. In the embodiment of the unwind system UWS3 of FIGS. 7A and 7B, new reels can be loaded, and expired reels removed, in the same manner as in FIGS. 1 and 2 or FIGS. 3 and 4; or either or both functions can be provided via automatic guided vehicle (AGV).

Figure 8A:
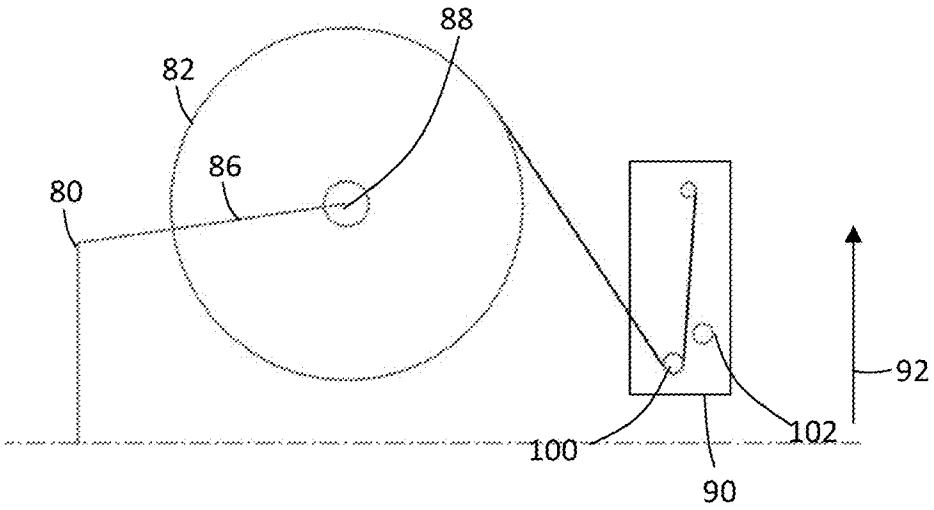
FIGS. 8A through 8G are elevation sketches of an embodiment of an unwinding machine of the present invention in various stages of a splicing sequence.
Figure 8B:
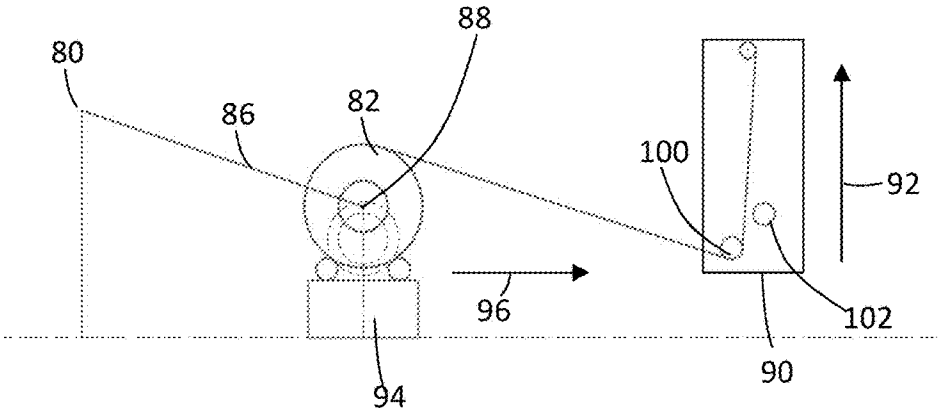
Figure 8C:
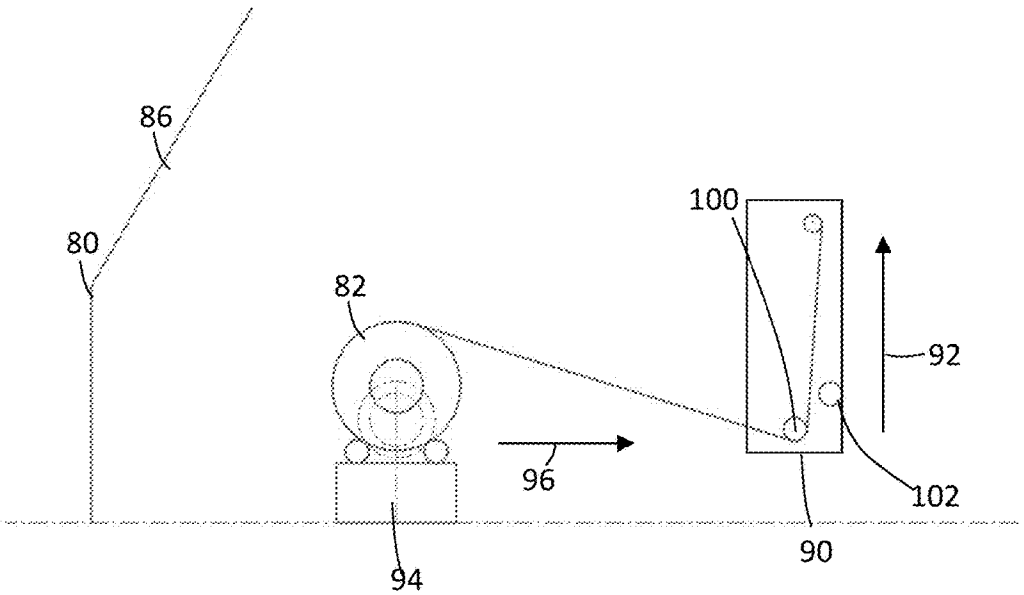
Figure 8D:
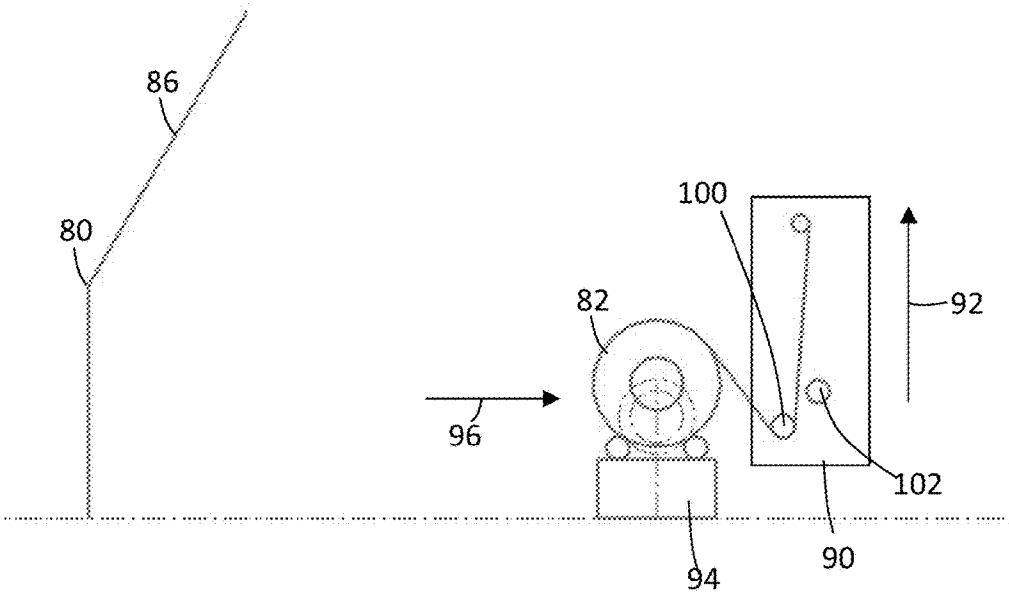
Figure 8E:
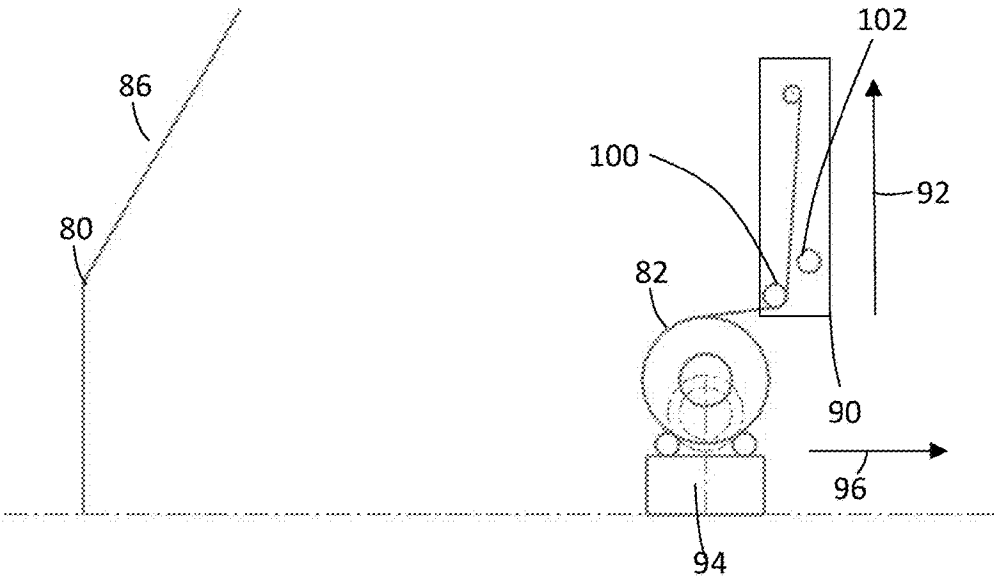
Figure 8F:
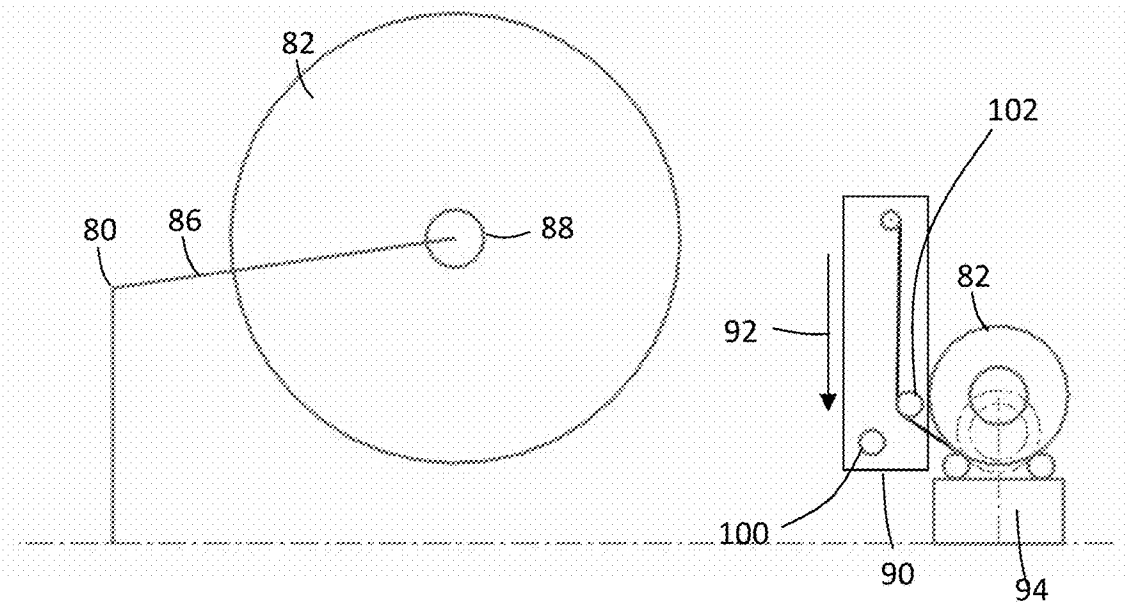
Figure 8G:
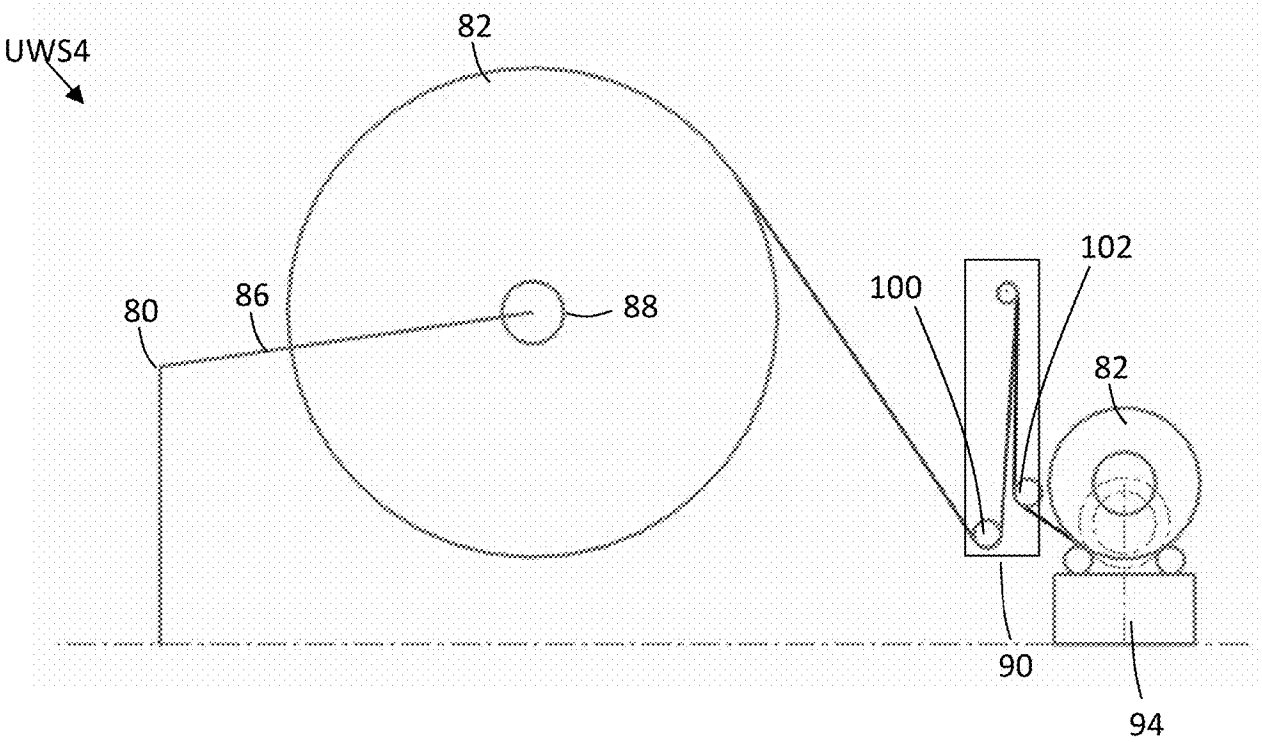

FIGS. 8A through 8G show a further embodiment of an unwinding system UWS4 with an unwind stand 80 with reel 82, arms 86 and chuck(s) 88 similar to the embodiments of the unwind systems UWS1,UWS2 of FIGS. 1 and 2 and FIGS. 3 and 4, but in an automatic splicing arrangement with one ply of web material. A difference from the embodiments of the unwind systems UWS1,UWS2 of FIGS. 1 and 2 and FIGS. 3 and 4 is that the splicing unit 90 is movable in the vertical direction 92. Another difference from the embodiments of the unwind systems UWS1,UWS2 of FIGS. 1 and 2 is that there is only one running position for each ply. A difference from the embodiments of the unwind systems UWS1,UWS2 of FIGS. 1 and 2 and FIGS. 3 and 4 is that a half section of the splicing unit may be omitted, because the splice is made in the same direction every time, instead of in alternating directions as in FIGS. 1 and 2 and FIGS. 3 and 4. The reels 82 may unwind either clockwise or counter-clockwise in the unwind stand 80. For the ease of illustration, the clockwise is shown in FIGS. 8A-8G. A core removal cart 94 similar to that disclosed in U.S. Pat. No. 5,934,604 may be provided; in the embodiment of the unwind system UWS4 of FIGS. 8A-8G, the vertical movement feature of the core removal cart shown in U.S. Pat. No. 5,934,604 may be omitted. The splicing unit 90 is movable in the vertical direction 92 to allow the core removal cart 94 to traverse beneath the splicing unit 90 with an expiring reel as it moves the expiring reel from a running position to a splice preparation position. When the running reel 82 reaches a given diameter, which diameter may be entered by an operator or saved in a program recipe, the core removal cart 94 may be positioned to support the expiring reel 82, and the reel lifting arms 86 may lower the expiring reel 82 onto the core removal cart, for instance, as shown in FIG. 8B. This diameter may be selected such that a sufficient length of web of acceptable quality remains on the expiring reel 82 to allow the splice sequence to be completed while the unwinding machine runs at a given web speed. The unwinding machine's web speed may be reduced at this point. The reel lifting arms 86 may then release the expiring reel 82 from the core chucks 88, while the core removal cart 94 continues to rotate the expiring reel to pay out web. Then, as shown sequentially in FIGS. 8C-8D, the core removal cart 94 traverses in the machine direction 96 toward the splicing unit 90. As shown in FIG. 8E, when the core removal cart 94 nears the splicing unit 90, enough of the splicing unit moves in the vertical direction 92 to allow the core removal cart to continue traversing beneath the splicing unit.

As the core removal cart 94 traverses beneath the splicing unit, the web may be transferred or "handed off" from a primary first guide roller 100 to a secondary first guide roller 102. The primary first guide roller may be a driven, high traction roller as described in U.S. Ser. No. 11/254,535. The secondary first guide roller 102 may be a driven, high traction roller as described in U.S. Ser. No. 11/254,535. The secondary first guide roller 102 may be an idling guide roller. The secondary first guide roller 102 may be a tension feedback roller. The web is handed off in this manner to allow the web of the new parent roll reel 82 to be threaded over the primary first guide roller 100. The tension control mode of the unwinding machine may be changed as the web is handed off from the primary first guide roller 100 to the secondary first guide roller 102, for example, from a tension mode to a draw mode. The vertical mobility of the splicing unit 90 can be provided with any of several known means, for example linear bearings, wheels, cam followers. The vertical movement of the splicing unit 90 can be provided with any of several known means, for example a rack and pinion drive, pneumatic or hydraulic cylinder(s), rodless cylinder(s), linear servo motor(s). When the core removal cart 94 has reached the splice preparation position, a new reel 82 can be loaded into the unwinding machine 80, and an operator can enter the splice preparation area to prepare the splice. Guarding may be provided to isolate the splice preparation area from the core removal cart 94; this guarding may be mounted to the splicing unit 90 and movable to allow the core removal cart 94 to pass by, or it may be mounted to the core removal cart 94. An advantage with the arrangement of the unwind system UWS4 of the embodiment of FIGS. 8A through 8G is that the floor space in the machine-direction 96 is reduced. A drawback with the arrangement of the unwind system UWS4 of the embodiment of FIGS. 8A through 8G is that the splice must be prepared while web is paid out from the core removal cart 94, which may be at a lower web speed than the unwinding machine's normal operating speed, meaning lower converting line efficiency. A drawback with the arrangement of the unwind system UWS4 of the embodiment of FIGS. 8A through 8G is that the running reel 82 must be unwound to a nearly expired diameter before a new reel 82 of maximum diameter can be loaded into the standby position. If loading carts are provided, a new reel of maximum diameter can be loaded onto a loading cart at any time, with the main risk being that if the cart is needed to remove a reel that is still relatively large in diameter, for example, because its quality is poor, then the new reel will need to be removed from the loading cart before the loading cart can be used to remove the bad reel.

The embodiment of the unwind system UWS4 of FIGS. 8A through 8G can be duplicated for 2-ply automatic splicing. New reels can be loaded in the same manner as in FIGS. 1 and 2 or FIGS. 3 and 4. Expired reels can be removed in a similar manner as in FIGS. 1 and 2 or FIGS. 3 and 4, or this function can be provided via automatic guided vehicle (AGV), or the core removal cart can be provided with cross-direction mobility and/or itself be configured as an automatic guided vehicle (AGV). The unwinding machine may stop in order to make the splice. The embodiment of the unwind system UWS4 of FIGS. 8A through 8G may be provided with a festoon web accumulator to allow the unwinding machine to continue to run at a web speed when the unwind stand stops in order to make the splice.

Figure 9A:
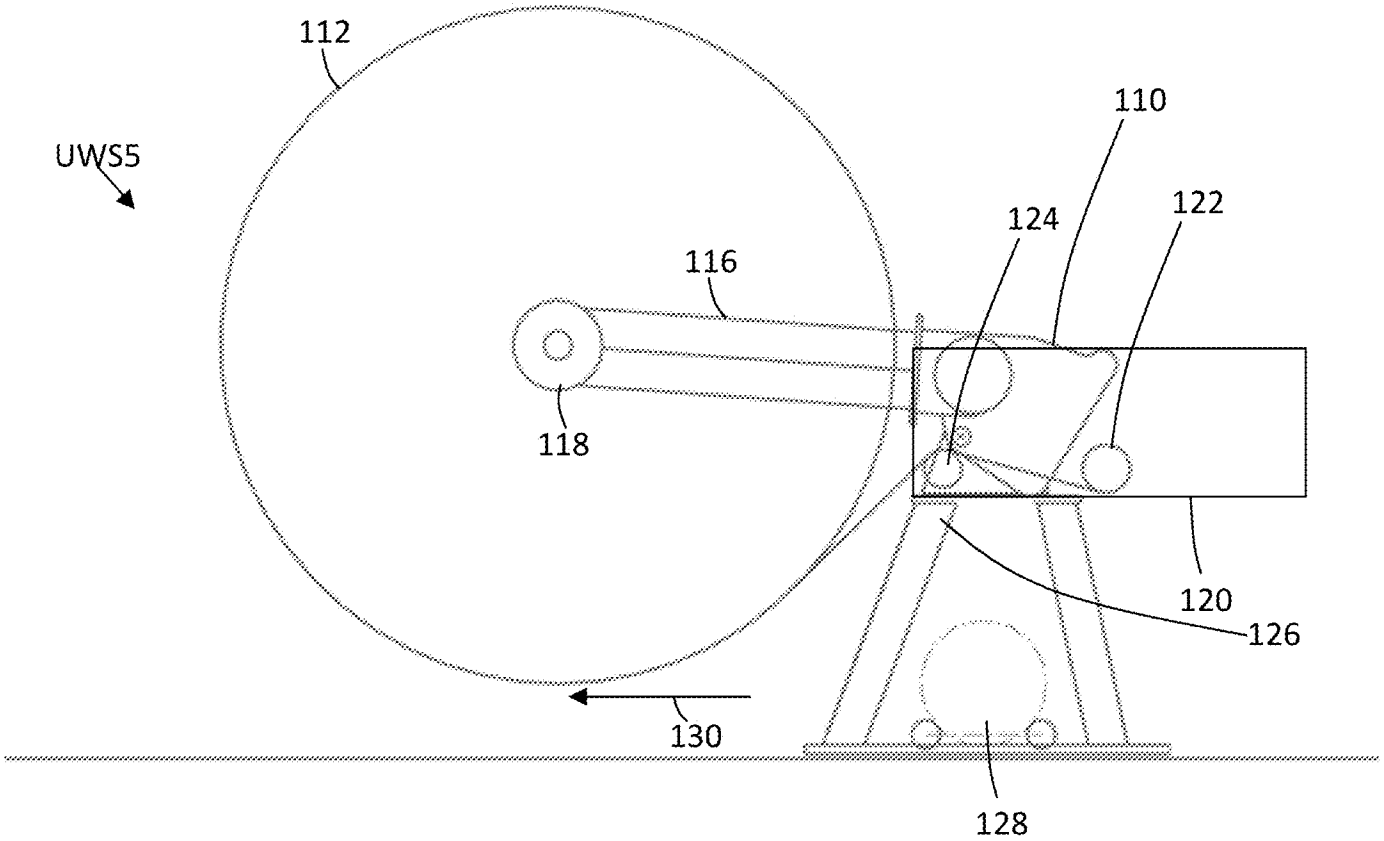
FIGS. 9A through 9G are elevation sketches of an embodiment of an unwinding machine of the present invention in various stages of a splicing sequence.
Figure 9B:
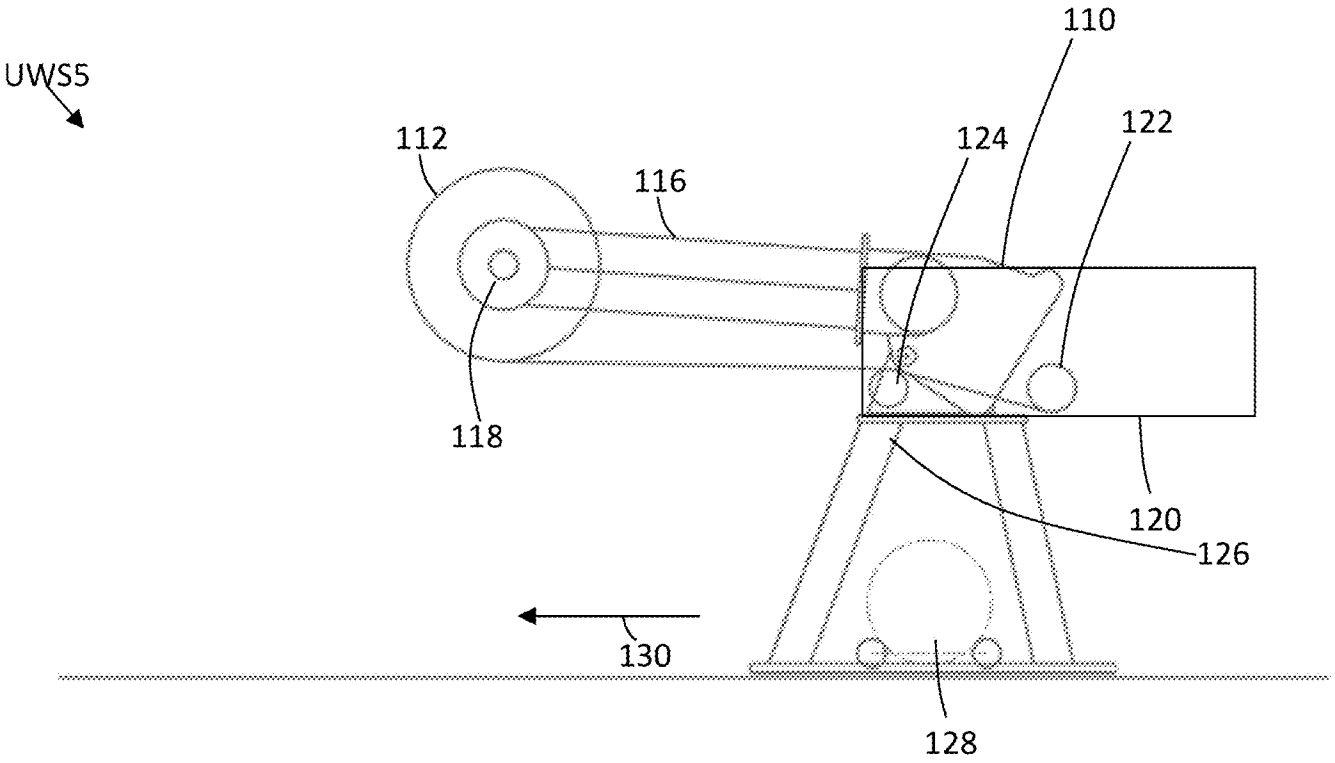
Figure 9C:
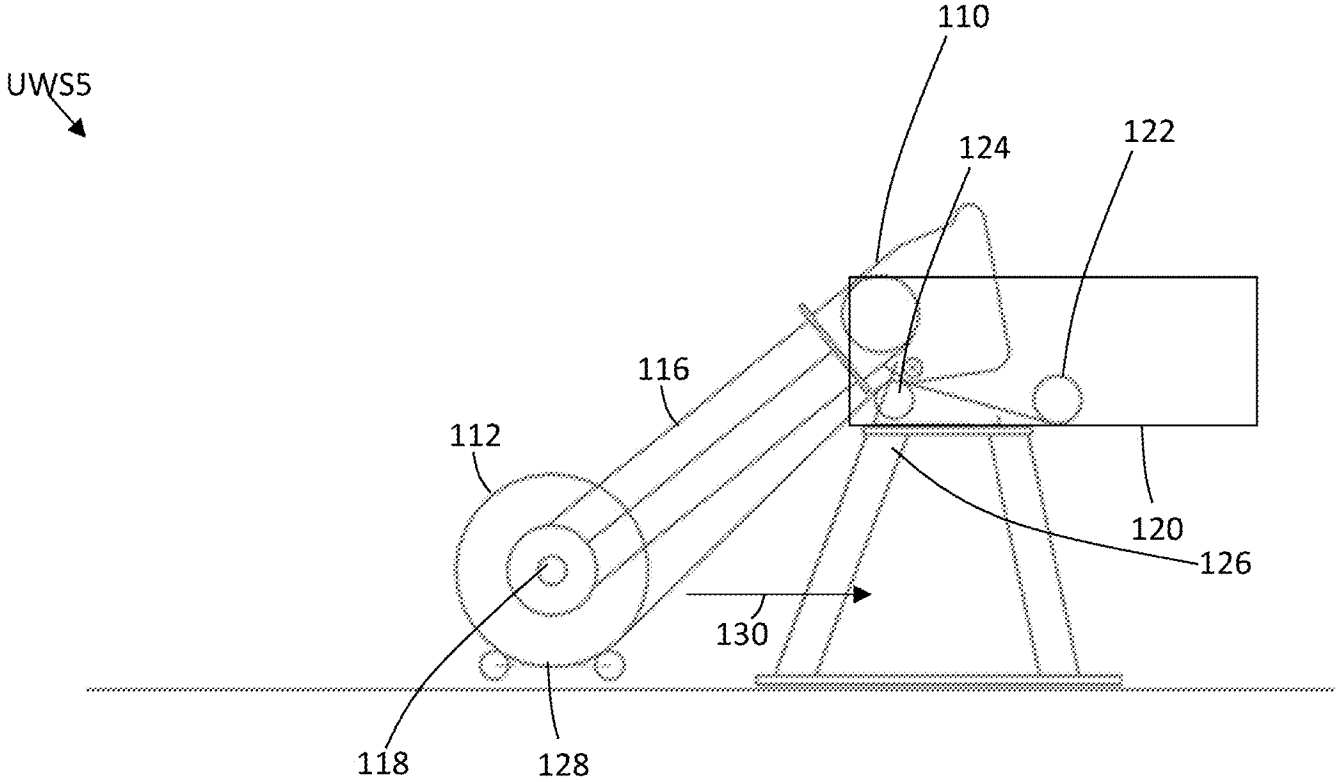
Figure 9D:
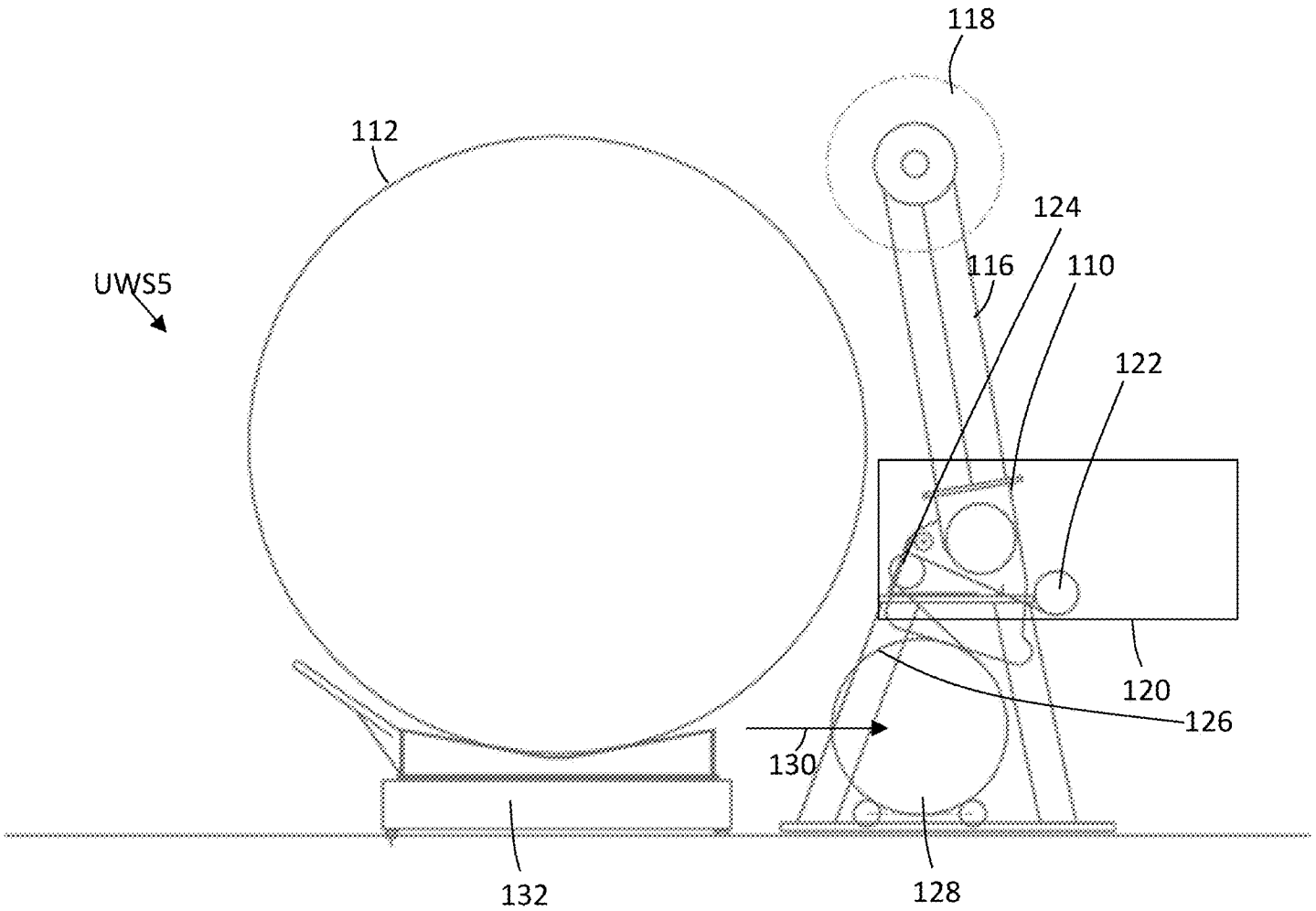
Figure 9E:
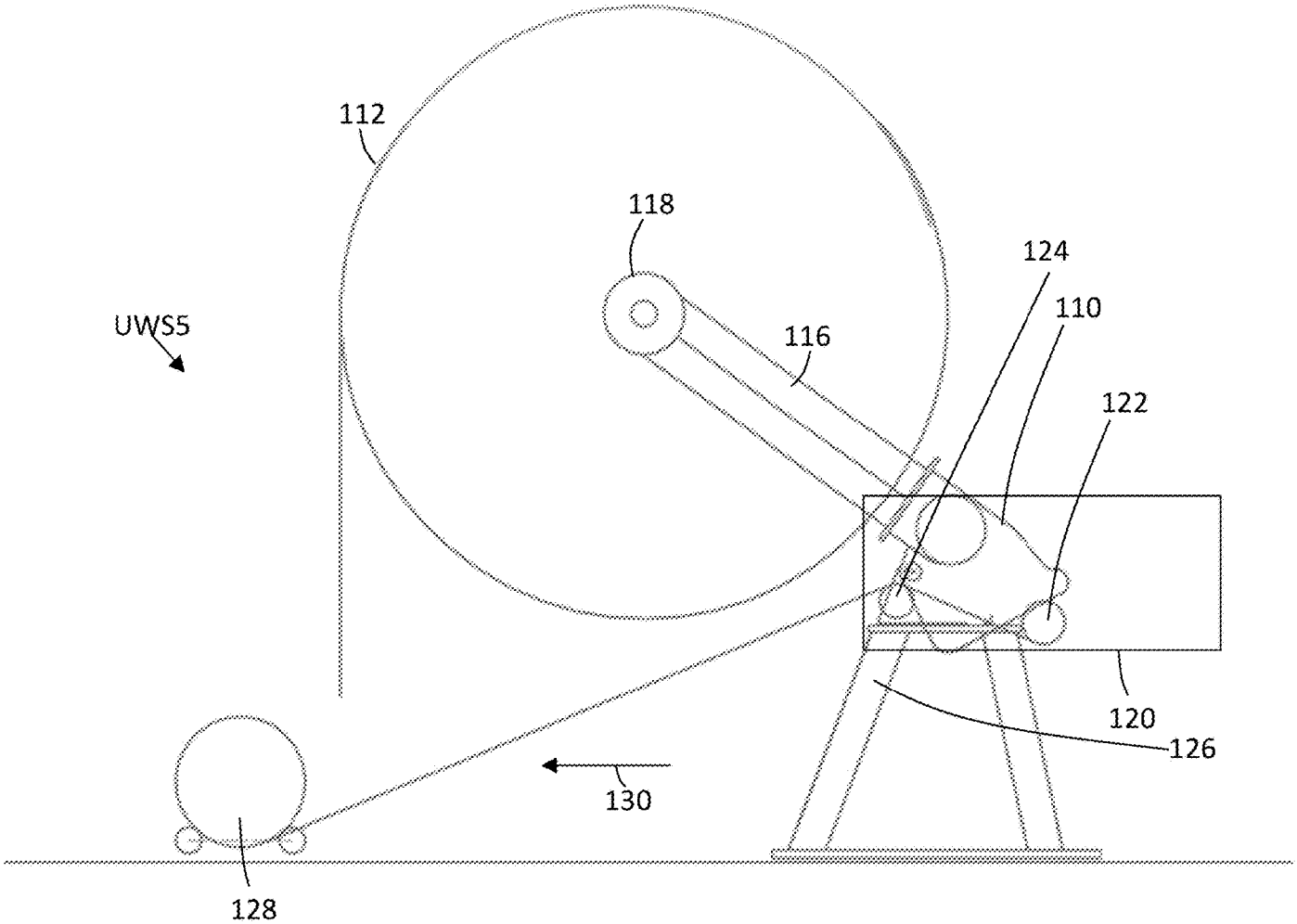
Figure 9F:
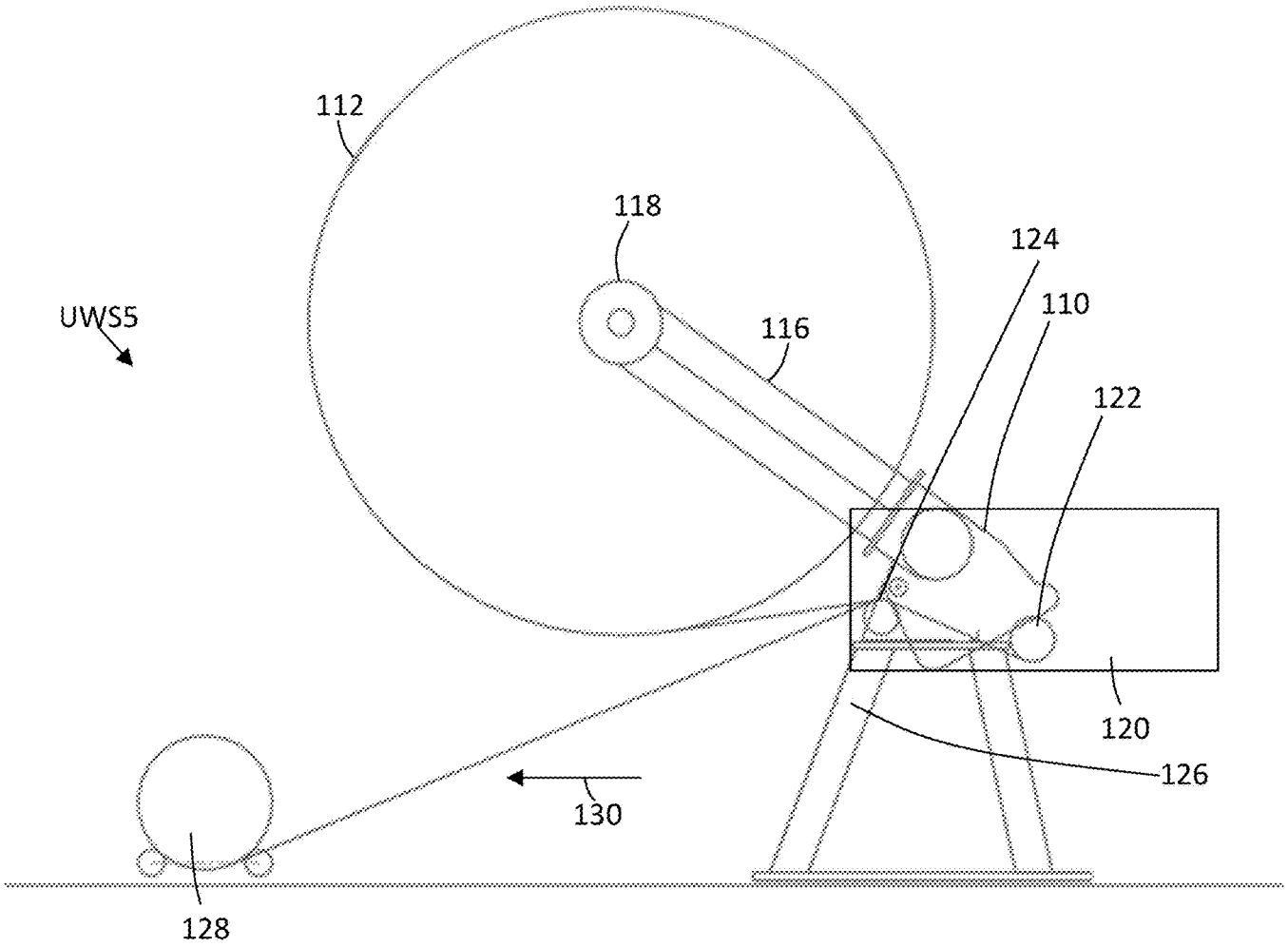
Figure 9G:
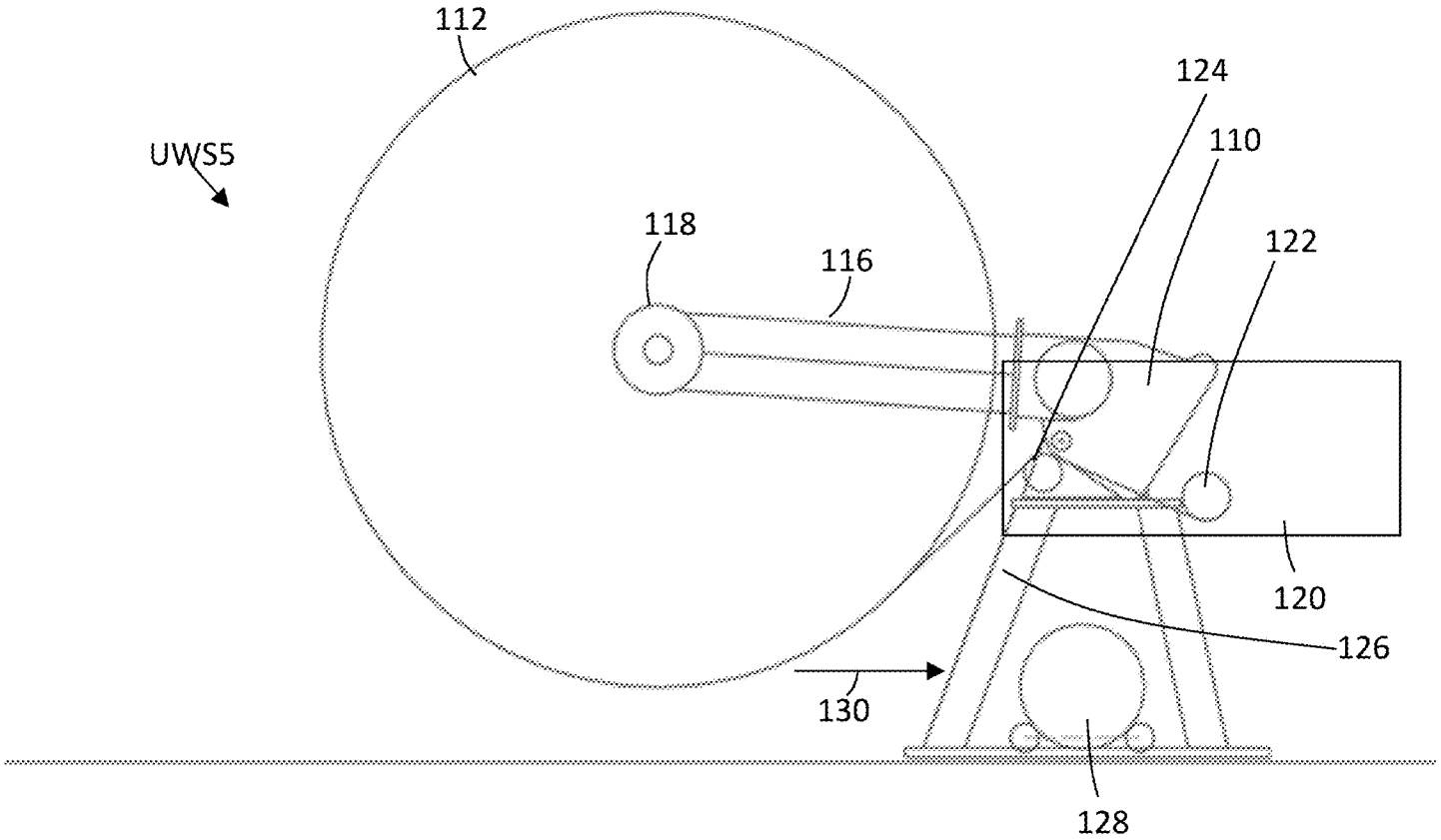

FIGS. 9A through 9G show a further embodiment of an unwinding system UWS5 with an unwind stand 110 with reel 112, arms 116 and chuck(s) 118 similar to the embodiments of the unwind systems UWS1,UWS2 of FIGS. 1 and 2 and FIGS. 3 and 4, but in an automatic splicing arrangement with one ply of web material. The embodiment of the unwinding system UWS5 of FIGS. 9A through 9G has some of the same aspects as the embodiments of the unwinding systems UWS1,UWS2 of FIGS. 1 and 2 and FIGS. 3 and 4. A difference in the embodiment of the unwinding system UWS5 of FIGS. 9A through 9G from the embodiments of the unwinding systems UWS1,UWS2 of FIGS. 1 and 2 and FIGS. 3 and 4 is that a preferred embodiment of the splicing unit 120 is the type using knurled plybonding wheels to mechanically knit the plies together. In the embodiment of the unwinding system UWS5 shown in FIGS. 9A through 9G, the anvil roller 122 of the plybonding wheel splice unit is the last roller in the web path illustrated in FIG. 9A. The first guide roller 124 (immediately upstream of the anvil roller in the web path) may be a driven, high traction roller as described in U.S. Ser. No. 11/254,535. A difference in the embodiment of the unwinding system UWS5 of FIGS. 9A through 9G from the embodiments of the unwinding systems UWS1,UWS2 of FIGS. 1 and 2 and FIGS. 3 and 4 is that the web is directed toward a support frame 126 of the unwind stand 110 instead of away from it. This arrangement provides for locating the "soft" side of each reel's ply on the outside of the finished roll product while also facilitating the splicing sequence. A difference in the embodiment of the unwinding system UWS5 of FIGS. 9A through 9G from the embodiments of the unwinding system UWS1 of FIGS. 1 and 2 is that there is only one running position for each ply. A core removal cart 128 similar to that disclosed in U.S. Pat. No. 5,934,604 may be provided; in this embodiment, the core removal cart's vertical movement feature may be omitted. When the running reel 112 reaches a given diameter, which diameter may be entered by an operator or saved in a program recipe, the reel lifting chucking arms 116 lower the reel 112 onto the core removal cart 128, for instance, as shown in FIG. 9C. This diameter may be selected such that a sufficient length of web of acceptable quality remains on the expiring reel to allow the splice sequence to be completed while the unwinding machine runs at a given web speed. The unwind stand's 110 web speed may be reduced at this point. The reel lifting chucking arms 116 unchuck the reel, and the core removal cart 128 continues to rotate the expiring reel to pay out web. Then the core removal cart 128 traverses in the machine direction 130 toward the support frame 126 of the unwind stand 110. When the core removal cart 128 has reached the position shown in FIG. 9D, a new reel 112 can be loaded into the unwind stand 110. The new reel may be loaded in position in the unwind stand 110 to be engaged with the reel lifting chucking arms 116 with a reel loading cart 132. Then, the core removal cart 128 traverses in the machine direction under the new reel 112, to the position shown in FIG. 9E. The "tail" of web hanging from the reel may be cut to a 'V' shape, with a strip of double-sided tape applied across the web at an intermediate point along the 'V'. At this point, the new reel 112 can begin to rotate, paying out web at a web speed substantially the same as the web speed of the unwinding machine, or at a somewhat slower speed than the web speed of the unwinding machine, so that the web of the new reel is brought into contact with the running web and pulled along with the running web. Once the new web reaches the plybonding wheels of the splicing unit 120, the plybonding wheels can be engaged against the anvil roll 122 to knit the webs together. After a suitable length of the two webs has been bonded together, the web of the expiring reel 112 can be cut or torn via known methods.

An advantage with the arrangement of the embodiment of the unwinding system UWS5 of FIGS. 9A through 9G is that the machine-direction floor space is reduced. A drawback with the arrangement of the unwinding system UWS5 of FIGS. 9A through 9G is that a new reel 112 must be loaded while web is paid out from the core removal cart 128, which may be at a lower web speed than the unwinding machine's normal operating speed, meaning lower converting line efficiency. If loading carts 132 are provided, a new reel of maximum diameter can be loaded onto a loading cart at any time, with the main risk being that if the cart is needed to remove a reel that is still relatively large in diameter, for example, because its quality is poor, then the new reel will need to be removed from the loading cart before the loading cart can be used to remove the bad reel. The embodiment of the unwinding system UWS5 of FIGS. 9A through 9G can be duplicated for 2-ply automatic splicing, with orientations mirrored so that the "soft" side of second reel's ply is located on the outside of the finished roll product. New reels can be loaded in the same manner as the embodiment of the unwinding system UWS1,UWS2 of FIGS. 1 and 2 or FIGS. 3 and 4. Expired reels can be removed in a similar manner as the embodiment of the unwinding system UWS1,UWS2 in FIGS. 1 and 2 or FIG. 3 and, or this function can be provided via automatic guided vehicle (AGV), or the core removal cart 132 can be provided with mobility in a cross-machine direction and/or itself be configured as an automatic guided vehicle (AGV).

Figure 10:
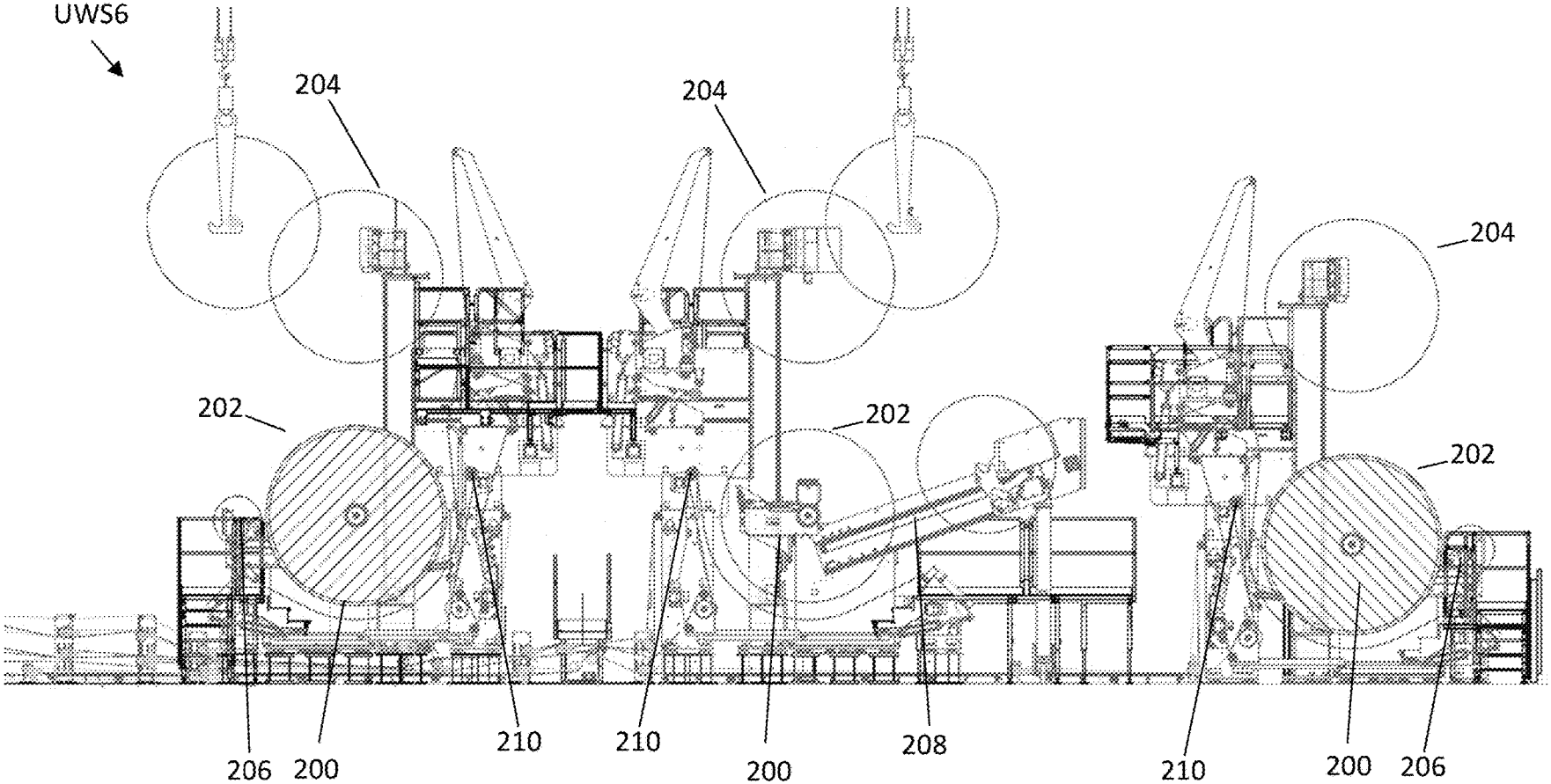
FIG. 10 is an elevation drawing showing another embodiment of an unwinding system.

FIG. 10 shows embodiments of prior art unwind systems UWS6 comprising surface belt-driven unwinding machines. The system comprises three unwind stands 200. Each of the three unwind stands 200 has a running position 202 along with a standby position 204 disposed above the running position, and additional drive belts for the standby position. The left- and right-most unwind stands as shown in FIG. 10 are provided with a typical expired reel discharge, in which the expired reel is discharged onto ramps 206 with a slight downward slope down which the expired reel rolls on its core plugs, or optionally the expired reel is moved along the slight downward or approximately horizontal path with a powered device. A powered expired reel device may additionally be provided with the capability to rotate the expired reel, for example to provide slack or tension in the web as needed, or to rewind extra web after the web of an expired reel is cut. The unwind stand in the center is additionally provided with an upward sloped path 208 for expired reel discharge. An upward sloped path for reel discharge allows for larger diameter reels to be ejected, for example to allow and operator to remove a section of defective web. The upward slope necessitates a powered device to move the expired reel.

An example process for splicing from an expired reel to a new reel using an unwind as shown in FIG. 10 is as follows. A new reel is prepared with double-sided tape across at least a portion of its width and loaded into the standby position 204. As the time for making the splice approaches, the converting line runs at a low speed, or stops. The new reel is lowered while a pressing roll 210 moves the web until the new reel and the web are in close proximity. The converting line begins to pull the expired web through the line at the same time that the new reel is optionally rotated by the additional drive belts of the standby position 204. The pressing roll 210 presses the expired web against the new reel until the double-sided tape has joined the expired web to the new reel, at which time the web of the expired reel is cut. The expired reel is ejected, and the new reel is lowered into the running position 202. As the new reel is lowered into the running position 202, the drive belts of the running position engage to drive the new reel, and if applicable the drive belts of the standby position disengage from the new reel.

Another example process for splicing from an expired reel to a new reel using an unwind as shown in FIG. 10 is as follows. In this example, the standby position and the additional drive belts disposed above the running position may be omitted. The converting line stops. The expired reel is ejected from the running position 202. The expired reel rolls down or preferably is powered along a reel ejection path, either slightly downward, approximately horizontally, or along an upward slope. The expired reel is rewound until a load cell detects tension in the web, and then unwound to provide slack in the web, at which point the web is laying on the drive belts. A new reel is prepared with double-sided splicing tape across at least a portion of its width and lowered onto the web of the expired reel. The unwind chucks engage the new reel. The web of the expired reel is cut. The converting line begins to pull the expired web through the line at the same time that the new reel is rotated. Either the pressure of the unwind drive belts, or preferably a separate pressing roll, or both, presses the expired web against the new reel until the double-sided tape has joined the expired web to the new reel. The new reel continues to rotate and pay out web to the converting line.

In any of the forgoing embodiments, if the controller of the unwinding system determines that the time remaining at the current web speed until the running reel expires is greater than the time needed to complete the splicing sequence, the unwinding machine can reduce the web speed until there is sufficient time to complete the splicing sequence, or if necessary stop running, and thereby prevent the downtime that would result from operators needing to rethread the converting line if the running reel were allowed to expire while the unwinding machine was running.

Further embodiments can be envisioned by one of ordinary skill in the art after reading this disclosure. In other embodiments, combinations or sub-combinations of the above-disclosed invention can be advantageously made. The example arrangements of components are shown for purposes of illustration and it should be understood that combinations, additions, re-arrangements, and the like are contemplated in alternative embodiments of the present invention. Thus, various modifications and changes may be made thereunto without departing from the broader spirit and scope of the invention as set forth in the claims and that the invention is intended to cover all modifications and equivalents within the scope of the following claims.

What is claimed is:

1. A method for unwinding reels in an unwinding system, the method comprising the steps of:

(i) loading a first reel comprising a convolutely wound web material into a first unwind position, (ii) unwinding the web of the first reel in the first unwind position, (iii) moving a splicing unit toward the first unwind position until there is sufficient space to allow a further reel to be loaded into a second unwind position, (iv) loading a second reel comprising a convolutely wound web into the second unwind position, (v) splicing the web from the first reel to the second reel, and (vi) cutting the web of the first reel.

2. The method of claim 1 further comprising the steps of:

(vii) removing the first reel from the first unwind position, (viii) unwinding the web of the second reel in the second position, (ix) moving the splicing unit toward the second unwind position until there is sufficient space to allow a further reel to be loaded into the first unwind position, (x) loading a third reel comprising a convolutely wound web into the first unwind position, and (xi) splicing the web from the second reel to the third reel.

3. The method of claim 2 wherein the step of removing the first reel from the first unwind position comprises removing the first reel with a conveyor.

4. The method of claim 2 wherein the step of removing the first reel from the first unwind position comprises removing the first reel with an automatic guided vehicle.

5. The method of claim 2 wherein the step of splicing the web from the second reel to the third reel comprises splicing the web with a double-sided tape.

6. The method of claim 1, wherein the step of loading at least one of the first reel and the second reel comprises loading the reel with a cart.

7. The method of claim 1 wherein the step of loading at least one of the first reel and the second reel comprises loading the reel with an automatic guided vehicle.

8. The method of claim 1 wherein the step of splicing the web from the first reel to the second reel comprises splicing the webs with double-sided tape.

9. The method of claim 1 wherein the step of loading the first reel into the first unwind position includes moving lifting arms of an first unwind station in a cross machine direction, engaging a core of the first reel with a core chuck of one of the lifting arms, and raising the lifting arms to a position sufficient to pay out web from the first reel.

10. The method of claim 1 wherein the step of loading the second reel into the second unwind position includes moving lifting arms of a second unwind station in a cross machine direction, engaging a core of the second reel with a core chuck of one of the lifting arms, and raising the lifting arms to a position sufficient to pay out web from the second reel.

* * * * *